US009358416B1

(12) United States Patent
Loebner

(10) Patent No.: US 9,358,416 B1
(45) Date of Patent: Jun. 7, 2016

(54) METHOD TO VARY TORQUE AROUND A JOINT DURING A SINGLE REPETITION OF AN EXERCISE

(71) Applicant: Hugh Gene Loebner, New York, NY (US)

(72) Inventor: Hugh Gene Loebner, New York, NY (US)

( * ) Notice: Subject to any disclaimer, the term of this patent is extended or adjusted under 35 U.S.C. 154(b) by 0 days.

(21) Appl. No.: 14/678,283

(22) Filed: Apr. 3, 2015

(51) Int. Cl.
*A63B 21/002* (2006.01)
*A63B 21/00* (2006.01)
*A63B 21/06* (2006.01)

(52) U.S. Cl.
CPC ..... *A63B 21/00185* (2013.01); *A63B 21/002* (2013.01); *A63B 21/06* (2013.01)

(58) Field of Classification Search
USPC ..... 482/1–148
See application file for complete search history.

(56) References Cited

U.S. PATENT DOCUMENTS

| | | | | |
|---|---|---|---|---|
| 4,563,003 | A * | 1/1986 | Bugallo | A63B 21/00181 482/100 |
| 5,328,429 | A * | 7/1994 | Potash | A63B 21/0058 482/4 |
| 5,653,666 | A * | 8/1997 | Pantoleon | A63B 21/078 482/108 |
| 7,998,041 | B1 * | 8/2011 | Johnson | A63B 21/0552 482/124 |
| 2006/0105890 | A1 * | 5/2006 | Logue | A63B 21/0724 482/106 |
| 2006/0281609 | A1 * | 12/2006 | Shah | A63B 21/072 482/109 |
| 2007/0259763 | A1 * | 11/2007 | McKeown | A63B 22/14 482/146 |

* cited by examiner

*Primary Examiner* — Stephen Crow

(57) ABSTRACT

It is possible to change the torque produced by a force on a joint during a repetition of an exercise having a kinetic chain comprising one or more several successively arranged intermediary joints dispersed between the said force and the said joint by changing the angles of the said intermediary joints.

2 Claims, 3 Drawing Sheets

METHOD TO VARY TORQUE AROUND A JOINT DURING A SINGLE REPETITION OF AN EXERCISE

FIELD OF THE INVENTION

This invention relates to resistance exercises to promote muscle growth. Specifically, it relates to a means to exercise one or more muscles such that the eccentric phase of the exercise requires more muscle force than does the concentric phase. A concentric contraction occurs when a muscle shortens under tension. An eccentric contraction occurs when a muscle lengthens under tension (the term "contraction" is used even though the muscle is lengthening). An isometric contraction occurs when a muscle maintains its length under tension.

The three types of contraction can be demonstrated in the act of lifting a cup of coffee for sip, and then lowering the cup. When raising the cup, the muscles of the arm contract, thus are concentrically forced While the cup is held raised at mouth height the muscles of the arm are isometrically forced When the cup is lowered to the table the muscles of the arm lengthen under tension eccentrically.

It is well known that muscles are stronger eccentrically than concentrically. It is also known that an eccentric stress on a muscle has greater anabolic consequences than does concentric stress on the muscle.

DESCRIPTION OF THE BACKGROUND ART here are numerous patents for means to exert a greater force during the eccentric phase of a repetition than during the concentric phase. Potash et. al., in U.S. Pat. No. 5,328,429A, titled: "Asymmetric force applicator attachment for weight stack type of exercise machines," describes "An attachment for a weight stack type exercise machine to pull the weight stack down while it is being lowered, so that the eccentric exercise force required to lower the stack is greater than the concentric exercise force required to raise it." Pantolean, in U.S. Pat. No. 5,653,666 A, titled: "Negative resistance weightlifting apparatus," describes an apparatus which "produces a negative resistance effect by pressing down with an adjustable force on . . . [a] weight as it is being lowered." Bugallo and Giamba, in U.S. Pat. No. 4,563,003 A, titled: "Weight lifting apparatus having increased force on the return stroke," describe an apparatus which "has a structure for lifting said weights against said gravity force and lowering said weights under said gravity. A resisting force in addition to said gravity force on the weight is applied to said structure during at least a portion of said downward movement of said weights."

These and other invention in the field have as their object to produce a greater force during the eccentric phase of an exercise repetition than in the concentric phase by means of some apparatus.

It is also well known that the torque around a joint may vary within the range of motion of the exercise by changes in the moment arm during the range of motion. De Simone (Bill De Simone, 2004, Moment Arm Exercise, Amazon, Spiral-bound) for example, describes such changes in moment arms during exercises.

SUMMARY OF THE INVENTION

This invention discloses a means to produce a greater torque on a joint, and hence load on a muscle, during the eccentric phase of an exercise repetition than in the concentric phase without the use of any apparatus beyond what is used to produce the concentric force. This is accomplished by changing the angles of intermediate joints in the kinetic chain from the force to the joint being exercised, which changes moment arm during the exercise. The moment arm of a torque is defined as the perpendicular distance from line of force to the axis of rotation. By varying this distance one may vary the torque applied by that force.

There are three preferred embodiments to this invention. They are based upon three widely known and practiced exercises: the situp with dumbbells, the cable fly, and the anterior deltoid raise.

DETAILED DESCRIPTION OF THE PREFERRED EMBODIMENTS

Figure 1:
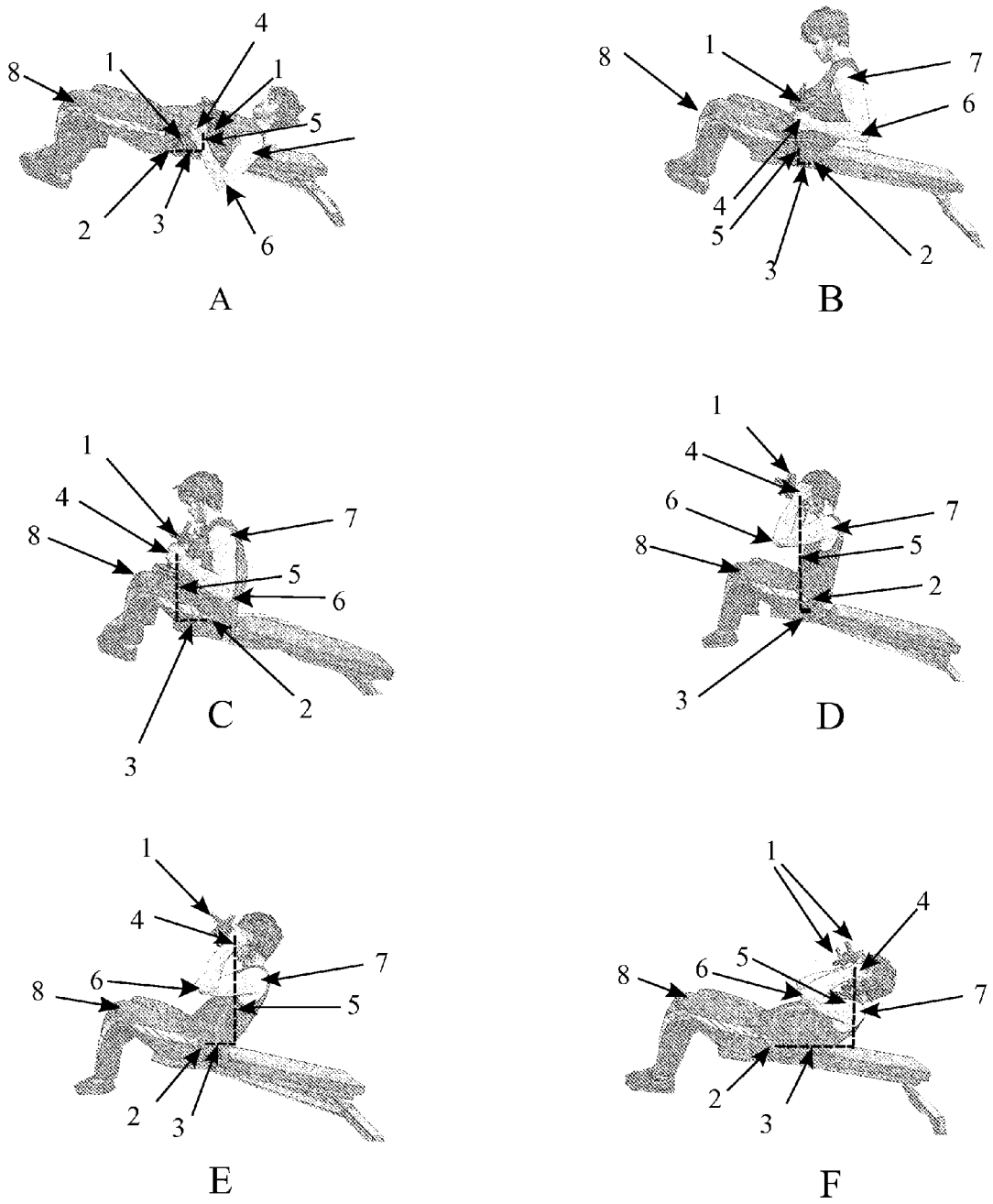
FIG. 1 Is an illustration showing the embodiment as a situp.

FIG. 1 shows the preferred embodiment when performed as a situp or "crunch" exercise. The purpose of this embodiment is to strengthen the abdominal muscles and the hip flexors. In the situp the joint under torque is primarily the hip and the intermediary joints dispersed in the kinetic chain between the force and the axis are the vertebrae, shoulders and the elbows. Rotation of the hip is in the sagittal plane. In this preferred embodiment the change in torque around the hip results from changes in the angles of the shoulder and elbows.

In FIG. 1, "A," "B," "C," "D," "E" and "F," are six representative positions assumed during the exercise. At the conclusion of the concentric phase the person performing the exercise increases the moment arm 3 around the hip joint 2 by changing the angles of elbows 6 and shoulders 7. The said increase in length of moment arm 3 during the eccentric phase will consequently result in an increase in torque around hip 2 during the eccentric phase.

Position labeled A in FIG. 1 shows the beginning of the concentric phase of the exercise. The person is supported on a declined support surface. Weights 1 are held in each hand 4 close to hip 2. Said weights 1 produce a moment arm 3 between hip 2 and force of gravity 5 producing torque around the axis of rotation hip 2. Moment arm 3 is the horizontal distance at right angle between the axis 2 and gravitational force 5 produced by weights 1.

Position labeled B in FIG. 1 shows the end of the eccentric phase. Hip 2 has been flexed. Weights 1 remain close to hip 2 and hence moment arm 3 produced by said weights is relatively small when compared with the moment arm produced when said weights are held distally from said hip.

Position labeled C in FIG. 1 shows weights 1 moving distally. They move away from hip 2 by means of flexing elbow 6.

Position labeled D in FIG. 1 shows the beginning of the eccentric phase. Weights 1 are moved to head level by means of flexing shoulder 7. Hip 2 begins to flex and head and torso descend as they revolve around axis of said hip.

Position labeled E and F in FIG. 1 shows the progress of the eccentric phase.

Comparing Positions A and F shows the shorter length of moment arm 3 when the weights are held close to hip 2 rather than distally. Given a constant force, the greater the moment arm the greater the torque, and hence the hips 2 of the person performing this embodiment will be subject to greater torque during the eccentric phase than during the concentric phase.

It will be noted by those skilled in the art that although I have described a weighted situp using dumbbell weights, the same principal applies to other sources of weight, such barbells, weight plates, kettleballs, etc. One possible embodiment involves no weights other than the weight of the lower arm. Hands may be held at hip level during the concentric phase and head level during the eccentric phase.

They will also realize that although in this embodiment the weights are held stable at head and hip level, other, intermediate positions are possible. One can change the torque at any time by changing the angles of shoulder and elbow, hence changing the moment arm. One could, for example, hold the weights at chest level during concentric phases and head level during eccentric phases.

Those skilled in the art will also realize that changing the moment arm during an exercise repetition allows one to tailor the moment arm to the strength of the muscles at various positions, since muscle strengths, in general, vary with degree of extension or contraction of said muscles.

Figure 2:
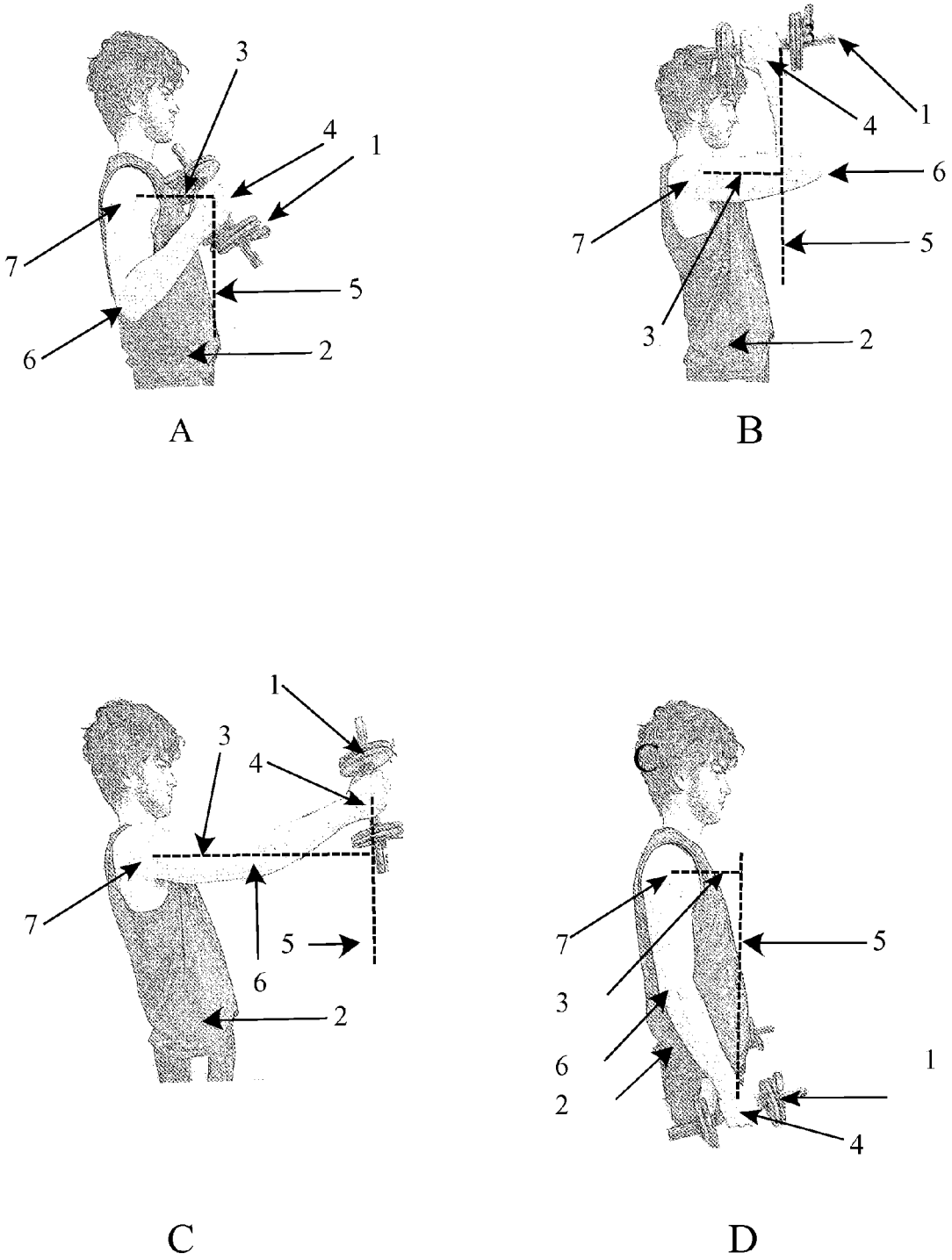
FIG. 2 Is an illustration showing the embodiment as an anterior deltoid raise.

FIG. 2 shows the preferred embodiment when performed as an anterior deltoid lift. As its name implies, the object of exercising the anterior deltoid. It is customarily performed by flexing and extending the shoulder in the sagittal plane while the arm is under load. In this embodiment, the person performing the exercise holds dumbbell free weights.

In FIG. 2, "A," "B," "C," and "D" are four representative positions assumed during the preferred embodiment of the exercise.

Position labeled A in FIG. 2 shows the beginning of the concentric phase of the exercise. The person is supported on an inclined support surface. Weights 1 are held in each hand 4 close to the chest by means of flexion of elbows 6 which are at waist level. The flexing and extending said elbow causes arm to revolve around the elbow 6 in the sagittal plane. Moment arm 3 is the horizontal distance at right angle between the shoulder 2 and gravitational force 5 produced by weights 1.

Position labeled B in FIG. 2 shows the end of the concentric phase of the exercise. Shoulder 7 and elbow 6 are flexed. Weights 1 are held perpendicular in each hand. The arm has revolved around shoulder 7 in the sagittal plane. Moment arm 3 is the horizontal distance at right angle between the shoulder axis 2 and gravitational force 5 produced by weights 1 held at upper arm length.

Position labeled C in FIG. 2 shows the beginning of the eccentric phase of the exercise. Elbow 6 has been extended in the sagittal plane so that weights 1 are held at arms length from shoulder 7. The lower arm has revolved around the elbow 6 in the sagittal plane. Moment arm 3 is the horizontal distance at right angle between the shoulder axis 2 and gravitational force 5 produced by weights 1. This moment arm is greater than that shown in Position A because of the added distance resulting from the extension of the elbow. It therefore follows that the torque on shoulder 7 will be greater during this phase than when the elbow is flexed as shown in Position B.

Position labeled D in FIG. 2 shows the end of the eccentric phase. Elbow 6 has been lowered to its original height. Weight 1 is at its lowest point during the exercise. The person exercising flexes elbow 6 thereby bringing weight 1 to its original position as shown in Position A.

Those skilled in the art will recognize that although this embodiment shows weights 1 at arm's length and elbow length, one can vary the torque on the shoulder at any point in an exercise repetition by degree of extension or flexing of elbow 6 thereby lengthening or shortening the moment arm. It is also possible to use other force generators such as elastic bands.

Figure 3:
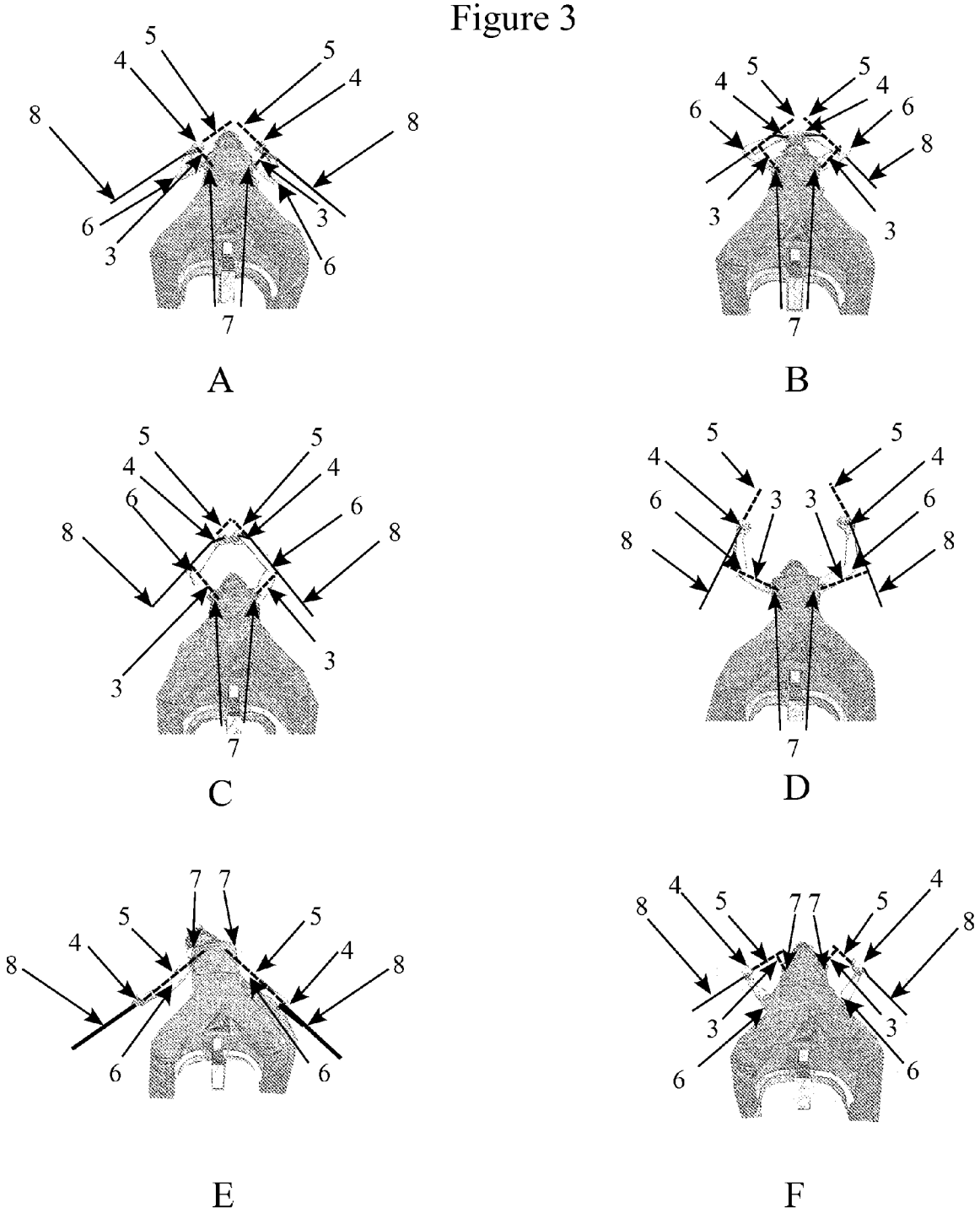
FIG. 3 Is an illustration showing the embodiment as a cable fly.

FIG. 3 shows preferred embodiment when performed as a cable fly. The purpose of this embodiment is to strengthen the pectoral muscle by performing transverse flexion of the arms.

In FIG. 3, "A," "B," "C," "D," "E" and "F," are six representative positions assumed during the exercise. In this embodiment, the person performing the exercise performs transverse flexion of the pectorals is in the transverse plane. Unlike the embodiments disclosed in FIGS. 1 and 2, the source of the force in this exercise is a cable under tension. The tension in cables 10 produce a moment arm 3 for torque around the axis of rotation shoulder 7.

Position labeled A in FIG. 3 shows the beginning of the concentric phase of the exercise. Cables 8 are held in each hand 4 with elbows 6 flexed. Moment arm 3 is the horizontal distance at right angle between shoulder 7 and tension force 5 in the direction produced by cables 8.

Position labeled B in FIG. 3 shows the end of the concentric phase. Transverse flexion of shoulders 7 has brought hands 4 together. Elbows 6 remain flexed. The length of moment arm 3 has not changed.

Position labeled C in FIG. 3 beginning of the eccentric phase. Elbows 6 extend, moving hands 4 distally from shoulders 7. Moment arm 3 increases in length.

Position labeled D in FIG. 3 shows the completion of the eccentric phase.

Positions labeled B and D in FIG. 3 show the greater length of moment arm 3 in the eccentric phase when compared to a comparable stage during the concentric phase. Given a constant force, the longer moment arm will produce the greater torque, and hence shoulder 7 of the person performing this embodiment will be subject to greater torque during the eccentric phase than during the concentric phase since moment arm 3 is longer during the eccentric phase.

It will be noted by those skilled in the art that although I have described an embodiment using cables, similar mechanics apply when the force is produced by another means, such as elastic bands.

They will also realize that although in this embodiment the handles are held stable at the elbow extended and elbow flexed positions, other, intermediate positions are possible, thereby changing torque on the shoulder. One can increase or decrease the torque at any time by changing the moment arm by flexing or contracting the elbow.

The invention claimed is:

1. A method of exercising the abdominal and oblique muscles using a weight structure from the group comprising dumbbells, barbells, kettleballs, or weight plates, consisting essentially of the steps (a) positioning the user on a declined support surface and moving said weight structure relatively toward the user's hips when said abdominal and oblique muscles are extended;

(b) contracting said abdominal muscles concentrically by raising the user's head;

(c) moving said weight structure relatively toward the user's head when said abdominal and oblique muscles are contracted;

(d) extending said abdominal muscles eccentrically by lowering the user's head.

2. A method of exercising the anterior deltoid muscle using a weight structure from the group comprising dumbbells, kettleballs, or weight plates, consisting essentially of the steps (a) positioning the user on an inclined support surface and moving said weight structure relatively closer to the user's shoulder by flexing the user's elbow (b) contracting said anterior deltoid muscle concentrically by raising the user's arm in the sagittal plane;

(c) moving said weight structure relatively further from the shoulder by extending the user's elbow when said anterior deltoid muscle has been contracted;

(d) extending said anterior deltoid muscle eccentrically by lowering the user's arm in the sagittal plane.

* * * * *